US008110072B2

(12) United States Patent
Ampulski

(10) Patent No.: US 8,110,072 B2
(45) Date of Patent: Feb. 7, 2012

(54) THROUGH AIR DRIED PAPERMAKING MACHINE EMPLOYING AN IMPERMEABLE TRANSFER BELT

(75) Inventor: Robert Stanley Ampulski, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 129 days.

(21) Appl. No.: 12/434,878

(22) Filed: May 4, 2009

(65) Prior Publication Data

US 2010/0230060 A1 Sep. 16, 2010

Related U.S. Application Data

(60) Provisional application No. 61/160,027, filed on Mar. 13, 2009.

(51) Int. Cl.
*D21F 9/00* (2006.01)

(52) U.S. Cl. ..... 162/306; 162/358.1; 162/375; 162/116

(58) Field of Classification Search ..... 162/109, 162/111, 113, 116, 207, 306, 358.1, 358.5, 162/359.1, 375; 34/114–117, 123
See application file for complete search history.

(56) References Cited

U.S. PATENT DOCUMENTS

| | | | |
|---|---|---|---|
| 3,741,212 | A | 6/1973 | Schutte |
| 3,821,068 | A | 6/1974 | Shaw |
| 3,879,257 | A | 4/1975 | Gentile et al. |
| 3,903,342 | A | 9/1975 | Roberts, Jr. |
| 4,000,237 | A | 12/1976 | Roberts, Jr. |
| 4,063,995 | A | 12/1977 | Grossman |
| 4,064,213 | A | 12/1977 | Lazorisak et al. |
| 4,127,637 | A | 11/1978 | Pietreniak et al. |
| 4,166,001 | A | 8/1979 | Dunning et al. |
| 4,326,000 | A | 4/1982 | Roberts, Jr. |
| 4,421,812 | A | 12/1983 | Plant |
| 4,422,892 | A | 12/1983 | Plant |
| 4,429,014 | A | 1/1984 | Isner et al. |
| 4,483,745 | A | 11/1984 | Wicks et al. |
| 4,500,588 | A | 2/1985 | Lundstrom |
| 4,514,345 | A | 4/1985 | Johnson et al. |
| 4,528,239 | A | 7/1985 | Trokhan |
| 4,529,643 | A | 7/1985 | Lundstrom |
| 4,976,821 | A | 12/1990 | Laapotti |
| 4,992,140 | A | 2/1991 | Anderson et al. |
| 5,002,638 | A | 3/1991 | Gulya et al. |
| 5,048,589 | A | 9/1991 | Cook et al. |
| 5,098,522 | A | 3/1992 | Smurkoski et al. |
| 5,245,025 | A | 9/1993 | Trokhan et al. |
| 5,260,171 | A | 11/1993 | Smurkoski et al. |

(Continued)

FOREIGN PATENT DOCUMENTS

EP 0576115 A1 12/1993

*Primary Examiner* — Eric Hug
(74) *Attorney, Agent, or Firm* — Peter D. Meyer

(57) ABSTRACT

A papermaking machine for making uncreped through air dried paper having a forming section, a press section, and a drying section is disclosed. The paper web is pressed between two press members while enclosed between a press felt and a transfer belt having non-uniformly distributed microscopic depressions in its surface. The web follows the transfer belt from the press to a transfer point at which the web is transferred via a suction transfer device onto a structuring fabric. The web is then dried with a through air dryer.

10 Claims, 4 Drawing Sheets

U.S. PATENT DOCUMENTS 5,275,700 A 1/1994 Trokhan
5,277,761 A 1/1994 Van Phan et al.
5,298,124 A * 3/1994 Eklund et al. ..... 162/306
5,328,565 A 7/1994 Rasch et al.
5,334,289 A 8/1994 Trokhan et al.
5,348,620 A 9/1994 Hermans et al.
5,399,412 A 3/1995 Sudall et al.
5,429,686 A 7/1995 Chiu et al.
5,431,786 A 7/1995 Rasch et al.
5,443,691 A 8/1995 Phan et al.
5,496,624 A 3/1996 Stelljes, Jr. et al.
5,500,277 A 3/1996 Trokhan et al.
5,503,715 A 4/1996 Trokhan et al.
5,514,523 A 5/1996 Trokhan et al.
5,527,428 A 6/1996 Trokhan et al.
5,534,326 A 7/1996 Trokhan et al.
5,554,467 A 9/1996 Trokhan et al.
5,566,724 A 10/1996 Trokhan et al.
5,591,309 A 1/1997 Rugowski et al.
5,593,545 A 1/1997 Rugowski et al.
5,614,061 A 3/1997 Van Phan et al.
5,624,790 A 4/1997 Trokhan et al.
5,628,876 A 5/1997 Ayers et al.
5,654,076 A 8/1997 Trokhan et al.
5,667,636 A 9/1997 Engel et al.
5,672,248 A 9/1997 Wendt et al.
5,679,222 A 10/1997 Rasch et al.
5,714,041 A 2/1998 Ayers et al.
5,746,887 A 5/1998 Wendt et al.
5,776,306 A 7/1998 Hepford
5,804,036 A 9/1998 Phan et al.
5,804,281 A 9/1998 Phan et al.
5,820,730 A 10/1998 Phan et al.
5,832,962 A 11/1998 Kaufman et al.
6,171,447 B1 1/2001 Trokhan
6,176,972 B1 * 1/2001 Oriaran et al. ..... 162/111
6,287,426 B1 * 9/2001 Edwards et al. ..... 162/281
6,319,365 B1 11/2001 Inoue
6,531,033 B1 3/2003 Kawashima
6,743,339 B1 6/2004 Nilsson et al.
6,998,024 B2 2/2006 Burazin et al.
7,563,344 B2 * 7/2009 Beuther et al. ..... 162/111
7,811,418 B2 * 10/2010 Klerelid et al. ..... 162/358.2
2005/0236122 A1 10/2005 Mullally et al.
2006/0243408 A1 * 11/2006 Blodgett et al. ..... 162/193
2008/0156450 A1 7/2008 Klerelid et al.

* cited by examiner

THROUGH AIR DRIED PAPERMAKING MACHINE EMPLOYING AN IMPERMEABLE TRANSFER BELT

PRIOR APPLICATION

This application claims priority to U.S. provisional application Ser. No. 61/160,027 filed on Mar. 13, 2009 the entirety of which is incorporated by reference herein.

FIELD OF THE INVENTION

The present disclosure relates to papermaking. More particularly, the present disclosure relates to a papermaking machine for making a paper web, and associated methods.

BACKGROUND OF THE INVENTION

Many attempts to combine the bulk-generating benefit of throughdrying with the dewatering efficiency of wet-pressing have been disclosed over the past 20 years. An exemplary process is disclosed in U.S. Pat. No. 6,287,426. A typical process utilizes a high pressure dewatering nip formed between a felt and an impermeable belt to increase the wet web consistency to about 35 to 50 percent. The web adheres to and follows the impermeable belt as it exits the press nip. The dewatered web is then transferred to a structuring fabric with the aid of a vacuum roll to impart texture to the web prior to drying.

Transfer belts having a regular or uniform grooved microstructure on their surface running in the machine direction have been used for transferring a web from a press felt to a further downstream process. The grooved belt is compressed flat in the dewatering press nip, allowing the dewatered web to transfer to the belt, but then rebounds to its natural grooved state soon after leaving the press. While effective for relatively heavy basis weight webs, the use of such modified belts still is not effective for processing light-weight tissue webs at high speeds necessary for commercial applications because of the difficulty associated with transferring low basis weight wet webs, which have virtually no strength. A wet tissue web will not naturally make such a transfer because there is a thin water film between the tissue web and the belt surface that generates a high adhesion force between the two materials. Attempts to remove the fragile tissue web from the belt surface often result in torn webs.

Therefore, there is a need for an efficient method of making wet-pressed paper webs at high speeds. This method is especially useful for the production of un-creped through air dried paper. AS would be appreciated, through air dried paper requires a significant amount of energy to dry. By pre-pressing the paper with the disclosed method, a significant amount of water is removed by mechanical means, thus reducing the thermal drying requirements of a through air dried process.

SUMMARY OF THE INVENTION

The present disclosure is directed to a papermaking machine and associated methods for forming a fibrous paper web from papermaking fibers, and in some embodiments for structuring the tissue web for increasing its effective bulk. In accordance with a first aspect of the disclosure, a papermaking machine for making a paper web comprises a forming section for forming a wet paper web, a press section arranged to receive the wet paper web from the forming section and operable to press the wet paper web to partially dewater the web, and a drying section for drying the paper web. The press section comprises at least one press having two cooperating press members forming a press nip therebetween, and a press felt arranged in a loop such that the press felt passes through the press nip. The papermaking machine further comprises an impermeable transfer belt arranged in a loop such that the transfer belt passes through the press nip and the wet paper web passes through the press nip enclosed between the press felt and the transfer belt. The papermaking machine further includes a final fabric arranged in a loop within which a through air dryer is disposed.

The suction transfer device has a suction zone in which suction is exerted through the final fabric, the suction zone including a transfer point spaced a distance, D, from the press nip in a machine direction along which the transfer belt runs, the transfer belt being arranged to bring the paper web into contact with the final fabric in the suction zone for a length, L, in the machine direction, such that suction is exerted on the paper web to transfer the paper web from the transfer belt onto the paper fabric at the transfer point.

The transfer belt has a surface in contact with the wet paper web characterized by a non-uniform distribution of microscopic-scale pits or depressions. By "microscopic-scale" is meant that the average diameter of the depressions is less than about 200 μm. For example, the depressions can range from 10 μm to about 200 μm, and more particularly from about 50 μm to about 200 μm in size. By "non-uniform" is meant that the depressions do not form a regular pattern but instead have an essentially random spatial distribution over the surface of the belt.

In one embodiment, the surface of the transfer belt (also referred to as a "particle belt") that contacts the wet paper web is formed by a coating of a polymeric resin having inorganic particles dispersed therein. The particles give the web-contacting surface a microscopically rough topography characterized by a non-uniform or random distribution of depressions. However, the desired belt surface can be provided in other ways. For example, a foamed polymeric surface can be formed and then sanded to expose the gas-filled pores of the foam, thus forming microscopic-scale depressions in the surface.

In one embodiment, the transfer belt runs at a speed of at least 1000 m/min, the distance, D, is at least about 2 m, and the length, L, is at least about 10 mm during machine operation.

In particular embodiments, the suction transfer device has a curved outer surface about which the final fabric is partially wrapped, and the transfer belt partially wraps the outer surface of the suction transfer device with the final fabric disposed between the suction transfer device and the transfer belt having the paper web thereon. For example, the transfer belt can preferably wrap the suction transfer device for the length, L, ranging from about 10 mm to about 200 mm, more preferably from about 10 mm to about 50 mm, measured as an arc length while vacuum is applied. The transfer belt diverges from the final fabric at a point P located at an outgoing end of the arc length, L.

In one embodiment, the suction zone, Z, is longer than the arc length, L, and extends downstream of the point P. The point, P, can be located intermediate between upstream and downstream ends of the suction zone, Z, in the machine direction.

In some embodiments, the papermaking machine is configured for making a tissue web having a basis weight less than about 20 grams/$m^2$ ("gsm"). Further, some embodiments are configured for making a structured tissue web, wherein the final fabric is a structuring fabric (also referred to as a "texturizing fabric") for imparting a structure to the tissue web for enhancing its effective bulk. The suction transfer device suctions the damp tissue web onto the structuring fabric to cause the tissue web to conform to its structured surface.

In accordance with another aspect of the disclosure, a method of configuring and operating a papermaking machine for making a paper web is provided. The method comprises steps of using a forming section to form a wet paper web, using a press section as previously described to press and dewater the wet paper web, and using a drying section to dry the paper web. The method further comprises the step of selecting the distance, D, between the press nip and the transfer point taking into account at least a linear speed of the transfer belt, a basis weight of the paper web, and a roughness characteristic of the surface of the transfer belt in contact with the wet paper web, such that within the distance, D, a thin water film between the paper web and the surface of the transfer belt at least partially dissipates to allow the paper web to be separated from the transfer belt without breaking.

In another aspect, the present disclosure describes a method for making a wet-pressed tissue comprising: (a) forming a wet tissue web having a basis weight of about 20 grams or less per square meter by depositing an aqueous suspension of papermaking fibers onto a forming fabric; (b) carrying the wet tissue web to a dewatering pressure nip while supported on a papermaking felt; (c) compressing the wet tissue web between the papermaking felt and a particle belt, whereby the wet tissue web is dewatered to a consistency of about 30 percent or greater and transferred to the surface of the particle belt; (d) transferring the dewatered web from the particle belt to a texturizing fabric, with the aid of vacuum, to mold the dewatered web to the surface contour of the fabric; (e) passing the wet web on the texturizing fabric through a through air dryer; and (f) drying to produce a tissue sheet.

The wet tissue web can be dewatered to a consistency of about 30 percent or greater, more specifically about 40 percent or greater, more specifically from about 40 to about 50 percent, and still more specifically from about 45 to about 50 percent. As used herein and well understood in the art, "consistency" refers to the bone dry weight percent of the web based on fiber.

The level of compression applied to the wet web to accomplish dewatering can advantageously be higher when producing light-weight tissue webs. Suitable press loads have a peak pressure of about 4 MPa or greater, more specifically from about 4 to about 8 MPa, and still more specifically from about 4 to about 6 MPa.

The machine speed for the method described above can be about 1000 meters per minute or greater, more specifically from about 1000 to about 2000 meters per minute, more specifically from about 1200 to about 2000 meters per minute, and still more specifically from about 1200 to about 1700 meters per minute. As used herein, the machine speed is measured as the linear speed of the particle belt.

The dwell time, which is the time the dewatered tissue sheet remains supported by the particle belt, is a function of the machine speed and the length of the particle belt run between the point at which the web transfers from the felt to the particle belt and the point at which the web transfers from the particle belt to the texturizing fabric. Because a light-weight wet tissue web is very weak, the water film between the web and the transfer belt needs to be well disrupted, more than for heavier paper grades, before subsequent transfer to the texturizing fabric is attempted. The water film break-up is a time-dependent process and, although various things (e.g., heat energy, electrostatic energy, surface energy, vibration) can accelerate it, the time available for the film to break up is reduced as the machine speed increases. Thus, all things being equal, the distance between the nip press and the point of transfer to the texturizing fabric (at the vacuum roll) needs to be increased beyond conventional distances in order to run faster. Similarly, the distance also needs to be increased in order to run lower basis-weight webs in order to achieve a more complete film break-up. It is estimated that the distance scales linearly with machine speed. Suitable distances between the nip press and the point of transfer to the texturizing fabric can be about 2.0 meters/1000 meters/minute of machine speed or greater, more specifically from about 2.5 to about 10 meters/1000 meters/minute of machine speed.

As used herein, a "texturizing fabric" (also referred to as a "structuring fabric") is a papermaking fabric, particularly a woven or a photo cured resinous papermaking fabric, having a topographical or three-dimensional surface that can impart bulk to the final tissue sheet. Examples of such fabrics suitable for purposes of this invention include, without limitation, those disclosed in U.S. Pat. Nos. 5,672,248; 5,429,686; 5,832,962; 6,998,024B2, and U.S. Patent Application Publication 2005/0236122A1. Other examples of photo cured resinous papermaking belts having a single layer of continuous patterned network for a framework and discrete deflection conduits are illustrated in U.S. Pat. Nos. 4,514,345; 4,528,239; 5,098,522; 5,260,171; 5,275,700; 5,328,565; 5,334,289; 5,431,786; 5,496,624; 5,500,277; 5,514,523; 5,554,467; 5,566,724; 5,624,790; and, 5,679,222. Papermaking belts having a single layer that forms a semi-continuous patterned network and semi-continuous deflection conduits may be made according to the teachings of U.S. Pat. Nos. 5,628,876 and 5,714,041. Papermaking belts having a single layer that forms discontinuous patterned network and continuous deflection conduits may be produced according to U.S. Pat. Nos. 4,514,345; 5,245,025; 5,527,428; 5,534,326; 5,654,076; 5,820,730; 5,277,761; 5,443,691; 5,804,036; 5,503,715; 5,614,061; 5,804,281, and 6,171,447.

The level of vacuum used to affect the transfer of the tissue web from the particle belt to the texturizing fabric will depend upon the nature of the texturizing fabric. In general, the vacuum can be about 5 kPa or greater, more specifically from about 20 kPa to about 60 kPa, still more specifically from about 30 kPa to about 50 kPa. The vacuum at the pick-up (vacuum transfer roll) plays a much more important role for transferring light-weight tissue webs from the transfer belt to the texturizing fabric than it does for heavier paper grades. Because the wet web tensile strength is so low, the transfer must be 100 percent complete before the belt and fabric separate, or else the web will be damaged. On the other hand, for heavier-weight paper webs there is sufficient wet strength to accomplish the transfer, even over a short micro-draw, with modest vacuum (20 kPa). For light-weight tissue webs, the applied vacuum needs to be much stronger in order to cause the vapor beneath the tissue to expand rapidly and push the web away from the belt and transfer the web to the fabric prior to fabric separation. On the other hand, the vacuum cannot be so strong as to cause pinholes in the sheet after transfer.

To further effect transfer and molding of the web into the texturizing fabric, the vacuum transfer roll may contain a second vacuum holding zone.

The transfer of the web to the texturizing fabric can include a "rush" transfer or a "draw" transfer. Rush transfers are transfers where the receiving fabric (downstream fabric) is traveling at a machine speed that is lower than the machine speed of the upstream fabric. Draw transfers are the opposite, i.e., the receiving fabric is traveling at a machine speed that is higher than the upstream fabric. Depending upon the nature of the texturizing fabric, rush transfer can aid in creating higher sheet caliper. When used, the level of rush transfer can be about 5 percent or less.

Fabric cleaning can be particularly advantageous, particularly using a method that leaves a minimal amount of water on the fabric (about 3 gsm or less). Suitable fabric cleaning methods include air jets, thermal cleaning, and high pressure water jets. Coated fabrics, which clean more-easily than non-coated fabrics, can be employed.

The bulk of the tissue sheets produced by the method of this invention can be about 10 cubic centimeters or greater per gram of fiber, more specifically from about 10 to about 20 cubic centimeters per gram of fiber (cc/g).

DETAILED DESCRIPTION OF THE INVENTION

The present inventions now will be described more fully hereinafter with reference to the accompanying drawings, in which some but not all embodiments of the inventions are shown. These inventions may be embodied in many different forms and should not be construed as limited to the embodiments set forth herein. Like numbers refer to like elements throughout.

Figure 1:
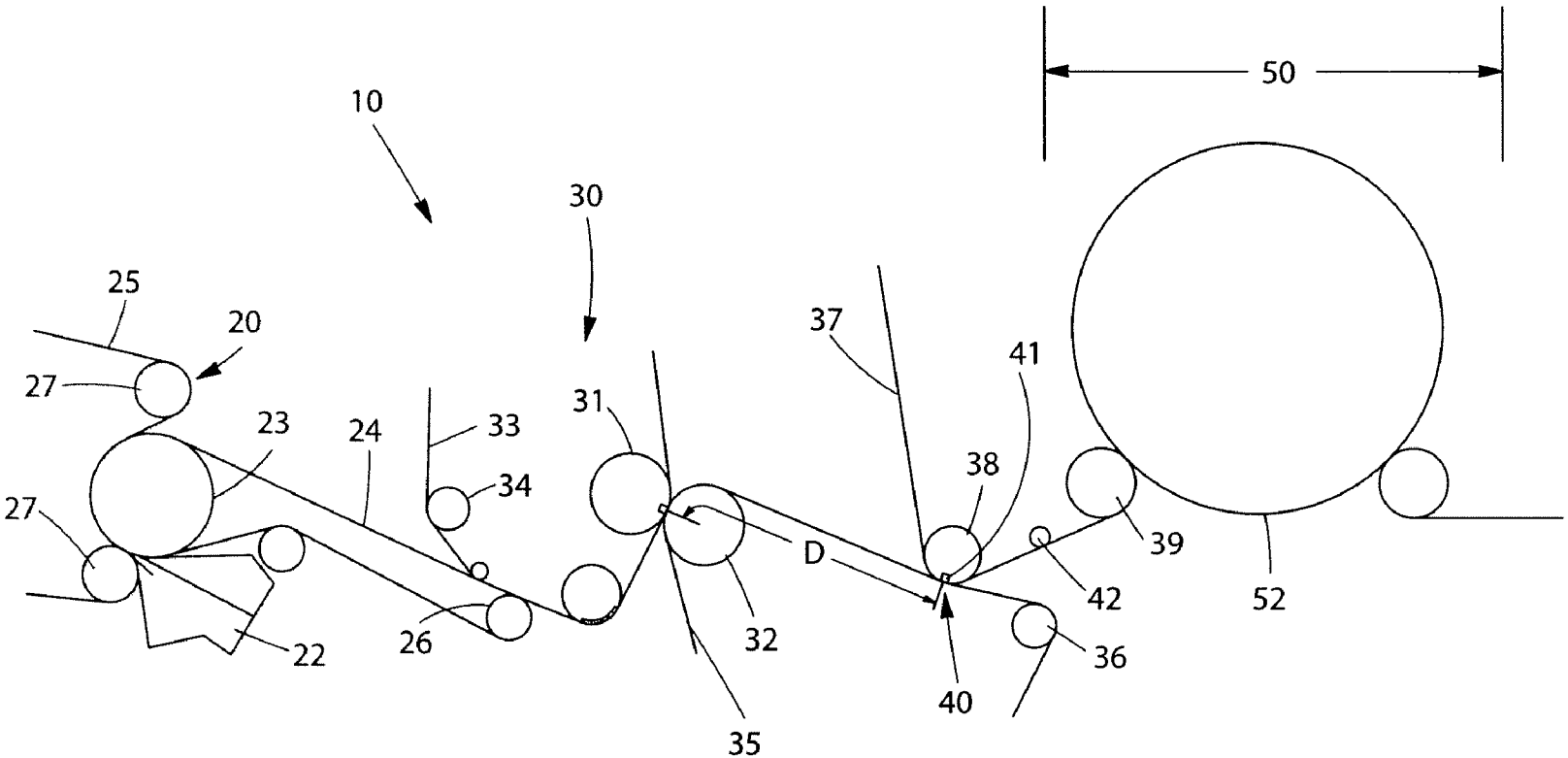
FIG. 1 is a schematic depiction of an exemplary papermaking machine in accordance with the present invention.

An exemplary papermaking machine 10 according the present invention is illustrated in FIG. 1. The papermaking machine comprises a wet section or forming section 20, a press section 30 and a drying section 50. The wet section 20 comprises a headbox 22, a forming roll 23, an endless inner clothing 24, and an endless outer clothing 25 consisting of a forming wire. The inner and outer clothings 24 and 25 run in separate loops around several guide rolls 26 and 27 respectively.

The drying section 50 preferably comprises a heated through air drying roll 52. The web can be then pre-dried by the heated through air drying roll 52 to any desired fiber consistency. The web can then be adhered to the surface of the Yankee dryer drum with a sprayed creping adhesive comprising 0.25% aqueous solution of Polyvinyl Alcohol (PVA). The resulting dried web is thereafter rolled into a parent roll (not shown) for subsequent conversion into the final product form as desired.

The press section 30 comprises at least one press, which has two cooperating first and second press members 31 and 32, which press members together define a press nip. Further, the press section comprises an endless press felt 33 that runs in a loop around the first press member 31 and guide rolls 34, and an endless impermeable transfer belt 35. The transfer belt 35 preferably runs in a loop around the second press member 32 and a plurality of guide rolls 36. A suction roll (not numbered) is also shown in FIG. 1, within the loop of the felt 33 at a location where the felt 33 overlaps with the inner clothing 24, upstream of the press nip. This suction roll dewaters the felt 33 and the paper web prior to the press nip. For example, the suction roll can operate at a vacuum of about 40 kPa, whereby the paper web entering the press nip can have a dry solids content of about 15% to 20%.

In the embodiment shown in FIG. 1, the press is a shoe press in which the first press member comprises a shoe press roll 31 and the second press member comprises a counter roll 32. The shoe press roll and the counter roll define an extended press nip therebetween. Other types of presses can be used instead of a shoe press.

The papermaking machine further comprises a permeable final fabric 37 arranged to run in a loop around a suction transfer device 38 located adjacent to the transfer belt 35 to define a transfer point 40 for transfer of the paper web from the transfer belt 35 to the final fabric 37. The transfer point 40 is located at a distance, D, from the press nip, as measured along the path traversed by the transfer belt 35. The suction transfer device 38 forms a suction zone 41 operable to exert suction through the final fabric 37 to transfer the paper web from the transfer belt 35 onto the final fabric 37. In the case of manufacturing a structured tissue web, the final fabric comprises a structuring fabric (or "texturizing fabric") having a structured surface, and the suction exerted by the suction transfer device 38 further serves to mold the damp tissue web to the structured surface of the fabric. The "structuring fabric" can be a woven structure, a photopolymer cured structure, or a Jaccard woven structure. The fabric 37 runs around a turning roll 39 that can guide the fabric into the through air drying section 50 of the paper machine and to any downstream processing equipment that may be required, such as a Yankee dryer and a parent roll winder.

In the embodiment shown in FIG. 1, the suction transfer device 38 is a suction roll having a suction zone 41 that encompasses a predetermined sector angle. The transfer belt 35 is arranged to partially wrap the curved outer surface of the suction device 38. As an alternative to a roll, the suction transfer device could be another type of suction device such as a suction shoe having a curved outer surface, or a suction box having a non-curved suction surface of a defined length, L.

The characteristics of the transfer belt 35 and the arrangement of the transfer belt 35 in relation to the structuring fabric 37 and suction transfer device 38 are of particular importance in the case of the manufacture of low-basis-weight tissue webs, such as tissue webs having a basis weight of about 20 gsm or less, more specifically from about 10 to about 20 gsm, still more specifically from about 10 to about 15 gsm. As used herein, "basis weight" refers to the amount of bone dry fiber in the web while positioned on the drying cylinder 52 during the tissue making process. This is to be distinguished from "finished" basis weight, which can be influenced by the presence of crepe folds that foreshorten the web in the machine direction. However, the basis weight of a tissue web on the dryer can be closely estimated from a finished basis weight by measuring the basis weight of the tissue web after all of the machine-direction foreshortening has been pulled out. Tissue webs having such low basis weight are particularly difficult to handle in a papermaking machine because a wet tissue web has virtually no tensile strength. As a consequence, the process of separating the tissue web from the transfer belt 35 and transferring it onto the structuring fabric 37 is complicated by the extremely low strength of the web.

More particularly, as the transfer belt 35 with the tissue web thereon exits the press nip formed by the press members 31, 32, a thin water film exists between the tissue web and the surface of the transfer belt 35. It is theorized that as long as this water film is intact, the tissue web cannot be separated from the transfer belt without significant risk of the web breaking. It has been found through multiple trials of transfer belts having different properties that the surface characteristics of the transfer belt play an important role in determining whether or not the tissue web can be separated from the transfer belt. Specifically, it has been found that some types of transfer belts make it difficult or essentially impossible to separate the tissue web, while other types of transfer belts allow the tissue web to be separated (as long as other criteria are also met, as further described below). Based on these trials, it is theorized that the transfer belts that permit the web to be separated somehow allow the thin water film to dissipate or break up after a certain period of time has elapsed after the web exits the press nip, while the transfer belts that do not permit the web to be separated without breaking do not allow the water film to dissipate.

In view of the trial results, it has been found that a papermaking machine such as the one depicted in FIG. 1 can be used for making tissue webs of low basis weight (as previously noted), as long as the transfer belt 35 has the proper surface characteristics that allow the water film to dissipate, and as long as there is a sufficient time period (referred to herein as the "dwell time," $t_d$) for the water film to dissipate. The dwell time is the period of time it takes for the web to travel the distance, D, from the press nip to the transfer point 40. The dwell time (in seconds) is related to the speed, V, of the transfer belt 35 (in meters per minute) by the equation $t_d$=(D/V)*60. For example, if V=1000 m/min and D=4 m, then $t_d$=0.24 second.

Regarding the surface characteristics of the transfer belt 35, it has been found that a transfer belt whose web-contacting surface is formed by a substantially nonporous polymeric coating, and which may have a surface that is ground or sanded to increase its surface roughness to an arithmetic average roughness, $R_a$, of about 2 μm to 5 μm generally does not allow the tissue web to be separated from the transfer belt even when the distance, D, is made long enough to provide a dwell time, $t_d$, of at least 0.5 s. It should be noted that for reasons of machine compactness it is usually desired to keep the distance, D, as small as possible while still allowing the tissue web transfer to be carried out reliably without breaking the web. It is likely that transfer belts with a substantially non-porous polymeric coating cannot be used, even if sanded to increase their surface roughness.

Such sanded or ground belts can be ground using a drum sander and thus have a web-contacting surface that is characterized by a plurality of grooves or striations extending along the machine direction (MD). As further described below, such belts having ground-in MD striations have been found to be generally unsuitable for making tissue webs of low basis weight (i.e., less than 20 gsm) at high machine speeds (i.e., at least 1000 m/min.). The precise reason why such belts do not allow the web transfer to take place at high speed is not well-understood, but it is theorized that the striations do not allow the thin water film to break up, possibly because each striation is generally continuous and thus may allow the water contained therein to remain intact via surface-tension effects.

On the other hand, it has been found that a transfer belt having a web-contacting surface characterized by a non-uniform distribution of microscopic-scale depressions (also referred to as "pits" or "holes"), even though its surface roughness is in generally the same range as the ground belts discussed above (e.g., $R_a$ of about 2 μm to about 10 μm) allows the tissue web to separate from the belt in a reasonably short distance, D. As an example, a suitable transfer belt 35 can comprise a G3 TRANSBELT®, or an LA TRANSBELT®, which are available from Albany International Corp., and are substantially as described in U.S. Pat. No. 5,298,124. Alternatively, the transfer belt can be a T2-style transfer belt from Ichikawa Co., Ltd., substantially as described in U.S. Pat. Nos. 6,319,365 and 6,531,033. The surface of the belt is formed by a coating of a resin such as acrylic or aliphatic polyurethane, into which is blended a quantity of inorganic particulate filler such as kaolin clay. The embedded particles of the filler give the surface of the belt a surface topography characterized by a non-uniform or random distribution of depressions on the microscopic scale as that term has been previously defined. The particles have a particle size generally less than about 50 μm, and a substantial proportion of the particles are less than about 10 μm.

The depressions have a range of diameters or sizes and a range of different shapes. The depression size is generally up to about 200 μm across. While the applicant does not wish to be bound by theory, it is thought that each depression can receive a tiny amount of water, and the water in one depression is separated from and thus not bound by surface-tension effects to the water in neighboring depressions, thereby allowing the thin water film effectively to break up and permit the paper web to be separated from the belt.

Even using the above-described type of "micro-depression" transfer belt, it is still necessary to meet a number of other criteria in order to assure that particularly low-basis-weight tissue webs can be successfully transferred to the structuring fabric 37 at the transfer point 40. These criteria include the dwell time, $t_d$, as previously noted, the dryness of the web exiting the press nip, the amount of suction exerted by the suction transfer device 38, and the specific manner in which the transfer belt 35 engages the suction transfer device.

Regarding the dwell time $t_d$, for machine speeds (i.e., the linear speed of the transfer belt 35) of at least 1000 m/min up to a maximum of about 2000 m/min (more particularly, 1000 m/min to about 1700 m/min, and still more particularly about 1200 m/min to about 1700 m/min), the dwell time, $t_d$, should be at least about 0.1 s, more particularly at least about 0.15 s, and still more particularly at least about 0.2 s. Based on the machine speed, the distance, D, can be estimated in order to provide the requisite dwell time. For example, if the machine speed has been set at 1500 m/min, then it can be estimated that the distance, D, likely should be at least about 2.5 m (to give a dwell time, $t_d$, of at least 0.1 s), more likely should be at least about 3.75 m (to give a dwell time of about 0.15 s), and still more likely should be at least about 5 m (to give a dwell time of about 0.2 s). This initial estimate of the distance, D, may need to be adjusted somewhat based on other factors, but can provide at least a rough estimate of the minimum distance that is likely to be workable. Of course, the distance, D, can always be made longer than the estimated minimum.

With respect to the dryness of the tissue web leaving the press nip, in general, the dryer the web is, the easier it is to separate the web from the transfer belt 35 because the wet strength of the web generally increases with increasing dryness. Generally, as the web dryness increases the distance, D, can be reduced. Conversely, the less dry the web is, the greater the distance, D, must be. The press section 30 of the papermaking machine 10 of FIG. 1 advantageously dewaters the tissue web to a dryness (i.e., dry solids content, on a weight percent basis) of at least about 20%, more particularly at least about 35%, still more particularly from about 35% to about 53%, and even more particularly from about 40% to about 50%. Such dryness levels can be achieved with a peak pressure load in the press nip of from about 2 MPa to about 10 MPa, more particularly from about 4 MPa to about 6 MPa.

The level of vacuum in the suction transfer device 38 used to effect the transfer of the tissue web from the transfer belt 35 to the structuring fabric 37 will depend upon the nature of the structuring fabric. In general, the vacuum can be about 5 kPa or greater, more specifically from about 20 to about 70 kPa, still more specifically from about 30 to about 50 kPa. The vacuum at the vacuum transfer device plays a much more important role for transferring light-weight tissue webs from the transfer belt to the structuring fabric than it does for heavier paper grades. Because the wet web tensile strength is so low, the transfer must be 100 percent complete before the belt and fabric separate, or else the web will be damaged. On the other hand, for heavier-weight paper webs there is sufficient wet strength to accomplish the transfer, even over a short micro-draw, with modest vacuum (20 kPa). For light-weight tissue webs, the applied vacuum needs to be much stronger in order to cause the vapor beneath the tissue to expand rapidly and push the web away from the belt and transfer the web to the structuring fabric prior to fabric separation. On the other hand, the vacuum should not be so strong as to cause pinholes in the sheet.

Additionally, as previously noted, the reliability of the web transfer onto the structuring fabric 37 is aided by properly configuring the suction transfer device 38 and its engagement with the transfer belt 35. In particular, the contact between the tissue web, W, on the transfer belt 35 and the structuring fabric 37 is not a tangential contact, but rather the contact area occupies a finite predetermined length, L, in the machine direction along which the transfer belt 35 runs. This area of contact at least partially coincides with the suction zone 41 of the suction transfer device 38. The area of contact having length, L, is delimited on the outgoing side by the point, P, at which the transfer belt 35 diverges or parts from the structuring fabric 37. The point, P, in particular embodiments can be located intermediate the upstream and downstream ends of the suction zone 41. In one embodiment, the point, P, is located approximately midway between the upstream and downstream ends of the suction zone 41. Accordingly, there is a portion of the suction zone 41 that is not covered by the transfer belt 35 and thus is open. Air is drawn into this open portion of the suction zone, through the permeable structuring fabric 37 and tissue web, at relatively high speed. This helps to mold the tissue web, W, to the structuring surface of the fabric. To further aid in molding the tissue web to the fabric, an additional suction device 42 can be disposed downstream of the suction transfer device 38. To further effect transfer and molding of the web to the structured surface of the fabric, the vacuum transfer roll may have a second holding zone following the suction zone 41, in which vacuum (generally at a lower level than in the suction zone 41) can be exerted. For instance, the second holding zone can have a vacuum of about 1 kPa to about 15 kPa.

In one embodiment, the point at which the transfer belt 35 first becomes tangent to the suction transfer device 38 defines an angle, $\alpha$, measured between the transfer belt 35 and structuring fabric 37 and a horizontal plane, the upstream end of the suction zone defines an angle, $\beta$, between the structuring fabric 37 and the horizontal plane, the point, P, at which the transfer belt 35 is tangent to the suction transfer device 38 at the outgoing side defines an angle, $\gamma$, between the transfer belt 35 and the horizontal plane, and the downstream end of the suction zone defines an angle, $\delta$, between the structuring fabric 37 and the horizontal plane. In one embodiment, the angle, $\alpha$, can be about 31.7°, the angle, $\beta$, can be about 30.7°, the angle, $\gamma$, can be about 29.6°, and the angle, $\delta$, can be about 11.9°. Thus, the total wrap of the transfer belt 35 about the suction transfer device is 2.1° ($\alpha$ minus $\gamma$), and the amount of that wrap subject to vacuum is 1.1° ($\beta$ minus $\gamma$). Given a suction transfer device diameter of about 800 mm, the wrap distance L corresponding to the 2.1° wrap is about 15 mm.

The press section optionally can include an adjustable roll, R, for the transfer belt 35 disposed upstream of the suction transfer device 38, the adjustable guide roll being adjustable in position with respect to the suction transfer device for adjusting the length, L, between a first value and a second value. Thus, the roll, R, is shown in a first position in solid line, for causing the transfer belt 35 to wrap the suction transfer device with a greater wrap angle to produce a longer length, L, and in a second position in broken line for causing the transfer belt to wrap the suction transfer device with a smaller wrap angle to reduce the length, L. As an example, the greater wrap length can be used at start-up of the papermaking machine, and once the tissue web is running well, the roll, R, can be moved to reduce the wrap length.

As the tissue web is subjected to a high vacuum and the web is still damp during the suction phase, the structure of the tissue web, W, will remain after the suction device(s). To achieve the desired structuring it is also advantageous that the speed of the fabric 37 is not greater than, and preferably is less than, the speed of the transfer belt 35. In particular, this difference in speed can range from about 0% to about 35%, more preferably from about 0% to about 15%, even more preferably from about 0% up to about 10%, and yet more preferably from about 0% to about 5%. However, in other embodiments, the speed of the fabric 37 can be slightly greater (e.g., up to about 3% greater) than that of the transfer belt 35 so as to effect a "draw" transfer of the tissue web, W, although this is not preferred.

The length, L, of the contact area in particular embodiments can be at least about 10 mm and can be up to about 200 mm. More particularly, the length, L, can be from about 10 mm to about 50 mm. It will be understood that the distance, L, is measured during machine operation when the suction transfer device is applying suction and the transfer belt is suctioned against the device.

Figure 2:
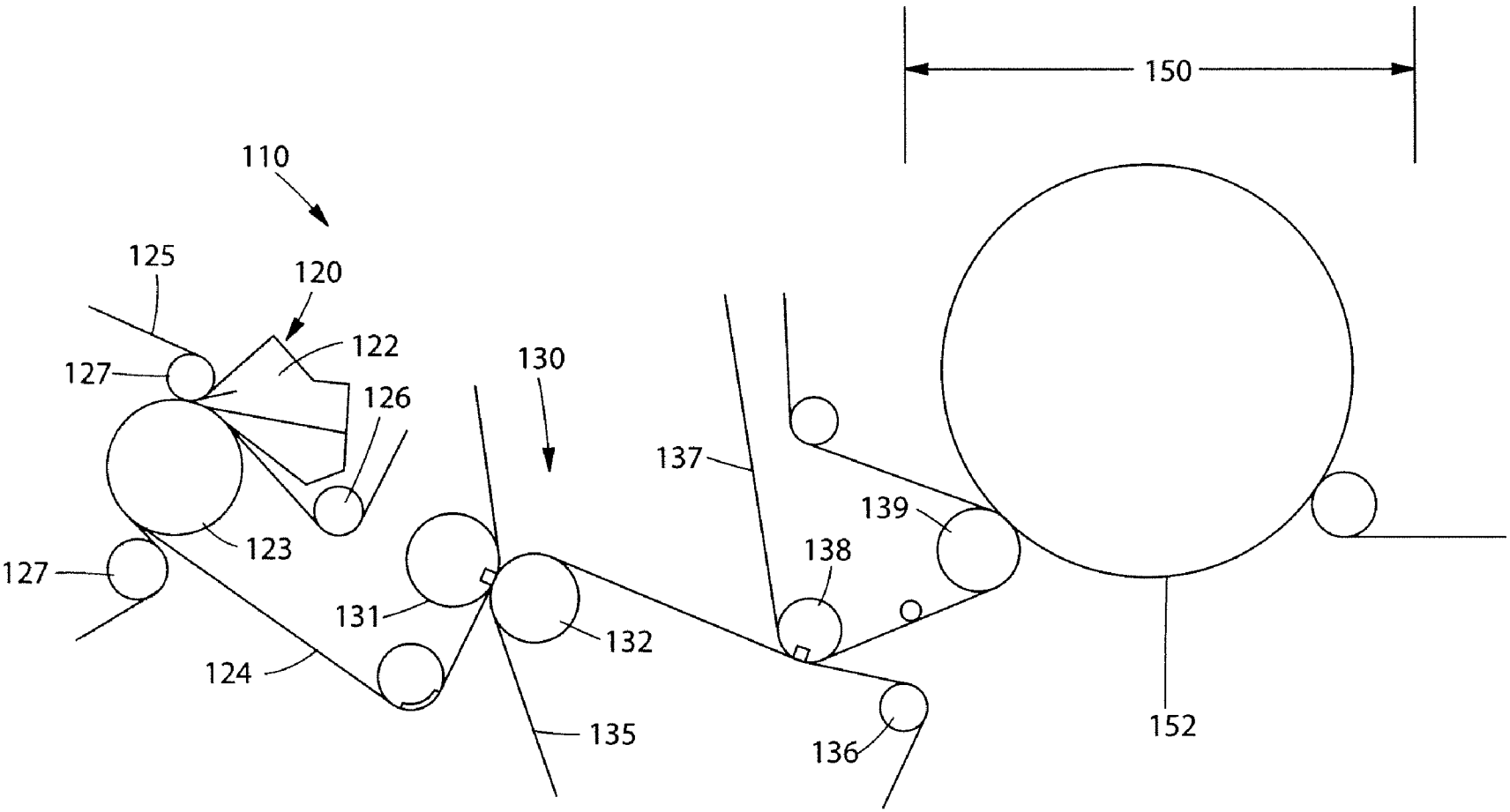
FIG. 2 is a schematic depiction of an alternative embodiment of a papermaking machine.

A papermaking machine 110 in accordance with another embodiment is shown in FIG. 2. This machine is generally similar to the machine 10 of FIG. 1. The machine includes a forming section 120, a press section 130 and a drying section 150. The forming section 120 comprises a headbox 122, a forming roll 123, an endless inner clothing 124, and an endless outer clothing 125 consisting of a forming wire. The inner and outer clothings 124 and 125 run in separate loops around several guide rolls 126 and 127 respectively.

The drying section 150 preferably comprises a heated through air drying roll 152. The resulting dried web is thereafter rolled into a parent roll (not shown) for subsequent conversion into the final product form as desired.

The press section 130 comprises at least one press, which has two cooperating first and second press members 131 and 132, which press members together define a press nip. Preferably, the press is a shoe press in which the first press member comprises a shoe press roll 131 and the second press member comprises a counter roll 132. Further, the press section comprises an endless impermeable transfer belt 135. The transfer belt 135 runs in a loop around the second press member 132 and a plurality of guide rolls 136. Unlike the machine of FIG. 1, the machine 110 of FIG. 2 does not employ a separate press felt, but instead the wet tissue web is formed on the clothing 124, which passes through the press nip such that the tissue web is enclosed between the clothing 124 and the transfer belt 135. In other respects, the machine 110 is generally similar to the machine 10 described above, and the disclosure with respect to the machine 10 applies as well to the machine 110.

Figure 3:
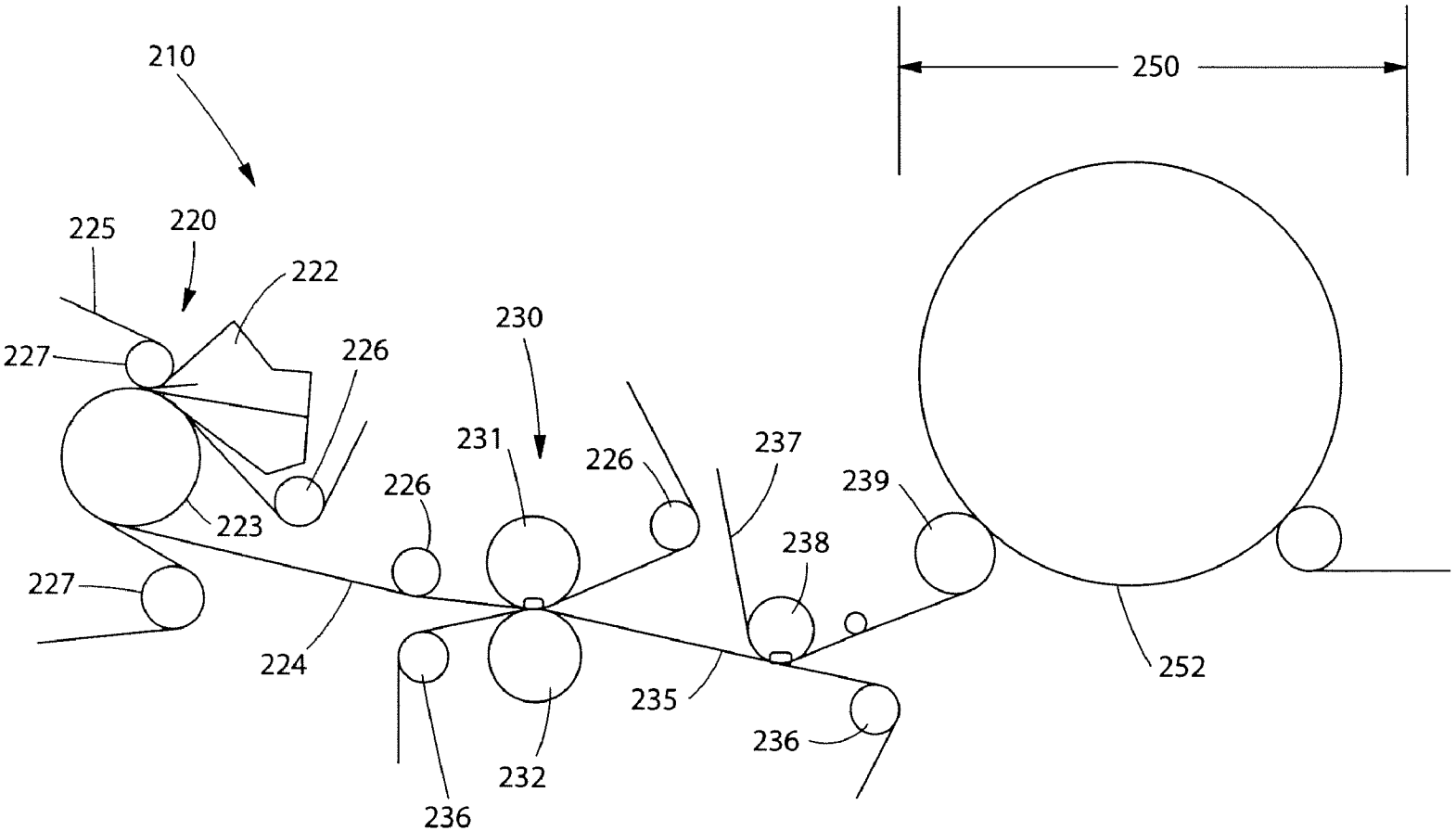
FIG. 3 is a schematic depiction of yet another embodiment of a papermaking machine; and, FIG. 4 is a schematic depiction of still another embodiment of a papermaking machine.

A papermaking machine 210 in accordance with a third embodiment is depicted in FIG. 3. The machine includes a forming section 220, a press section 230 and a drying section 250. The forming section 220 comprises a headbox 222, a forming roll 223, an endless inner clothing 224, and an endless outer clothing 225 consisting of a forming wire. The inner and outer clothings 224 and 225 run in separate loops around several guide rolls 226 and 227 respectively.

The drying section 250 preferably comprises a heated through air drying roll 252. The resulting dried web can thereafter be rolled into a parent roll (not shown) for subsequent conversion into the final product form as desired.

The press section 230 comprises at least one press, which has two cooperating first and second press members 231 and 232, which press members together define a press nip. Further, the press section comprises an endless impermeable transfer belt 235. The transfer belt 235 runs in a loop around the second press member 232 and a plurality of guide rolls 236. Unlike the machine of FIG. 1, the machine 210 of FIG. 3 does not employ a separate press felt, but instead the wet tissue web is formed on the clothing 224, which passes through the press nip such that the tissue web is enclosed between the clothing 224 and the transfer belt 235. In other respects, the machine 210 is generally similar to the machine 10 described above, and the disclosure with respect to the machine 10 applies as well to the machine 210.

Figure 4:
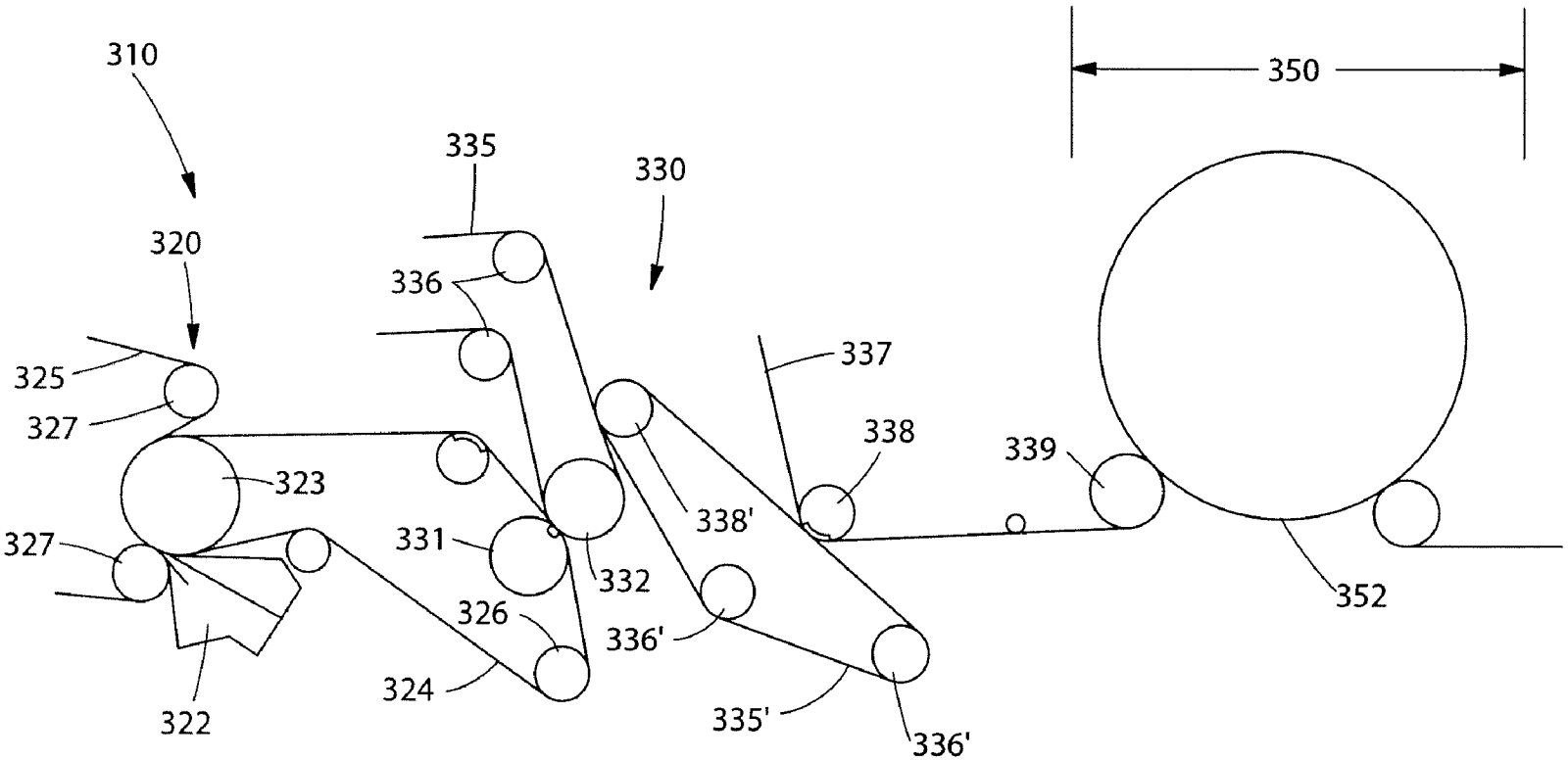

A papermaking machine 310 in accordance with a fourth embodiment is shown in FIG. 4. The machine includes a forming section 320, a press section 330 and a drying section 350. The forming section 320 comprises a headbox 322, a forming roll 323, an endless inner clothing 324, and an endless outer clothing 325 consisting of a forming wire. The inner and outer clothings 324 and 325 run in separate loops around several guide rolls 326 and 327 respectively.

The drying section 350 comprises a heated through air drying roll 352. The resulting dried web can thereafter be rolled into a parent roll (not shown) for subsequent conversion into the final product form as desired.

The press section 330 comprises at least one press, which has two cooperating first and second press members 331 and 332, which press members together define a press nip. Further, the press section comprises an endless impermeable transfer belt 335. The transfer belt 335 runs in a loop around the second press member 332 and a plurality of guide rolls 336. As in the machines of FIGS. 2 and 3, the machine 310 of FIG. 4 forms the wet tissue web on the clothing 324, which passes through the press nip such that the tissue web is enclosed between the clothing 324 and the transfer belt 335.

Unlike the machines of FIGS. 2 and 3, however, the machine 310 includes a further permeable belt 335' that runs in an endless loop about guide rolls 336' and about a suction transfer device 338'. The tissue web on the transfer belt 335 is brought into engagement with the permeable belt 335' on the suction transfer device 338' such that the tissue web is transferred onto the permeable belt. The tissue web is then transferred onto the structuring fabric 337 with the aid of the suction transfer device 338 about which the structuring fabric is partially wrapped. The tissue web is molded to the surface of the fabric 337. The fabric 337 runs around a turning roll 339, which guides the fabric into the through air section of the paper machine.

One could also make patterned densified paper on this machine by drying the sheet in the predrying section to 90% or less and then transferring the sheet to a Yankee cylinder which may include a hood, further drying, creping, and reeling the tissue product The bulk of the tissue sheets produced by the papermaking machine in accordance with the present disclosure can be about 10 cubic centimeters or greater per gram (cc/g) of fiber, more specifically from about 10 to about 20 cc/g.

As used herein, "bulk" is calculated as the quotient of the "caliper" (hereinafter defined) of a tissue sheet, expressed in microns, divided by the dry basis weight, expressed in grams per square meter. The resulting sheet bulk is expressed in cubic centimeters per gram. More specifically, the tissue sheet caliper is the representative thickness of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

The "surface roughness" of the transfer belts can be measured by several methods, including optical microscopy of cross-sections of the belt, or by stylus profilometry of the surface. Since the roughness of the belt surface may differ in the MD and CD directions with the CD value typically greater, the stated roughness is the CD roughness. A suitable portable device that enables in-field measurement is made by Taylor-Hobson Corporation, Model Surtronic 25 Ra.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

In the interest of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4; and 4-5.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A papermaking machine for making a paper web from an aqueous suspension of papermaking fibers, comprising:

a forming section structured and arranged to form a wet paper web;

a press section arranged to receive the wet paper web from the forming section, the press section comprising a press having two cooperating press members forming a press nip therebetween, a press felt arranged in a loop such that the press felt passes through the press nip, and an impermeable transfer belt arranged in a loop such that the transfer belt passes through the press nip and the wet paper web passes through the press nip enclosed between the press felt and the transfer belt;

a permeable structuring fabric arranged in a loop within which a suction transfer device is disposed, the suction transfer device having a suction zone in which suction is exerted through the structuring fabric, the suction zone including a transfer point spaced a distance D from the press nip in a machine direction along which the transfer belt runs, the transfer belt being arranged to bring the paper web into contact with the structuring fabric in the suction zone for a length L in the machine direction, such that suction is exerted on the paper web to transfer the paper web from the transfer belt onto the structuring fabric at the transfer point;

the transfer belt having a surface in contact with the wet paper web characterized by a non-uniform distribution of microscopic-scale depressions; and, a through air dryer which the structuring fabric with the paper web traverses for drying the paper and a drying cylinder onto which the structuring fabric transfers the paper web for final drying and creping thereof.

2. The papermaking machine of claim 1 wherein the surface of the transfer belt that contacts the wet paper web is formed by a coating of a polymeric resin having inorganic particles dispersed therein and has an arithmetic average surface roughness, $R_a$, of about 2 μm to 10 μm.

3. The papermaking machine of claim 1 wherein the transfer belt runs at a speed of 1000 m/min or greater, the distance, D, is at least about 2 m, and the length, L, is at least about 10 mm.

4. The papermaking machine of claim 3 wherein the distance, D, is about 2.5 m to about 4 m.

5. The papermaking machine of claim 1, wherein the transfer belt runs at a speed of at least 1500 m/min.

6. The papermaking machine of claim 1, wherein the transfer belt runs at a linear speed that is greater than a linear speed of the structuring fabric such that a rush transfer of the tissue web onto the structuring fabric is effected.

7. The papermaking machine of claim 1, wherein the suction transfer device has a curved outer surface about which the structuring fabric is partially wrapped, and the transfer belt partially wraps the outer surface of the suction transfer device with the structuring fabric disposed between the suction transfer device and the transfer belt having the tissue web thereon.

8. The papermaking machine of claim 7, wherein the transfer belt wraps the suction transfer device for the length, L, measured as an arc length, of about 20 mm to about 200 mm, the transfer belt diverging from the structuring fabric at a point, P, located at an outgoing end of the arc length, L.

9. The papermaking machine of claim 8, wherein the suction transfer device forms a suction zone, Z, operable to exert suction through the structuring fabric to transfer the paper web from the transfer belt onto the structuring fabric, wherein a length of the suction zone, Z, is longer than the arc length L and extends downstream of the point, P, and the point, P, is located intermediate between upstream and downstream ends of the suction zone, Z, in the machine direction.

10. A through air dried paper made by the apparatus of claim 1.

* * * * *